US010041742B2

(12) United States Patent
Fontaine et al.

(10) Patent No.: US 10,041,742 B2
(45) Date of Patent: Aug. 7, 2018

(54) HEAT EXCHANGER SIDE PLATE WITH FIN

(71) Applicant: DENSO International America, Inc., Southfield, MI (US)

(72) Inventors: Joshua Fontaine, Royal Oak, MI (US); Rajeev Sharma, Troy, MI (US)

(73) Assignee: DENSO International America, Inc., Southfield, MI (US)

( * ) Notice: Subject to any disclaimer, the term of this patent is extended or adjusted under 35 U.S.C. 154(b) by 317 days.

(21) Appl. No.: 14/802,273

(22) Filed: Jul. 17, 2015

(65) Prior Publication Data

US 2017/0016681 A1 Jan. 19, 2017

(51) Int. Cl.
*F28F 9/02* (2006.01)
*F28D 9/00* (2006.01)

(52) U.S. Cl.
CPC ..... *F28D 9/0093* (2013.01)

(58) Field of Classification Search
CPC ..... F28D 1/00; F28D 1/02; F28D 1/04; F28D 1/0233; F28D 2001/026; F28D 1/0375; F28D 9/00; F28F 1/32; F28F 3/12; F28F 3/14; F28F 9/007; F28F 9/0075; F28F 9/0131; F28F 9/02; F28F 9/0229; F28F 9/0278; F28F 2009/222; F28F 9/24
USPC ..... 165/148, 149, 151, 153, 168, 170, 171
See application file for complete search history.

(56) References Cited

U.S. PATENT DOCUMENTS 5,954,123 A * 9/1999 Richardson ..... F28F 9/001 165/149
6,237,676 B1 * 5/2001 Hasegawa ..... B60K 11/04 165/140
6,328,098 B1 * 12/2001 Kodumudi ..... F28F 9/001 165/149
6,408,939 B1 * 6/2002 Sugimoto ..... F28D 1/0435 165/135
6,412,547 B1 * 7/2002 Siler ..... F28F 9/001 165/149
7,389,810 B2 * 6/2008 Harada ..... F28F 9/001 165/149
7,621,317 B2 * 11/2009 Rousseau ..... F28F 9/001 165/149
8,794,300 B2 * 8/2014 Irmler ..... F02B 29/0475 165/140
2006/0000587 A1 * 1/2006 Ando ..... F28F 9/001 165/149
2006/0272801 A1 * 12/2006 Ikawa ..... B23K 1/0012 165/149
2008/0230211 A1 * 9/2008 Hutchins ..... F28D 1/05366 165/151
2014/0202670 A1 * 7/2014 Tylutki ..... F28F 9/001 165/149

* cited by examiner

*Primary Examiner* — Keith Raymond
*Assistant Examiner* — Gustavo Hincapie Serna

(57) ABSTRACT

A heat exchanger includes a core, which has a plurality of core fins and a plurality of tubes, and a side plate. The plurality of tubes extend along a first direction. The plurality of core fins are stacked with the plurality of tubes along a second direction, which is perpendicular to the first direction. The side plate is stacked with the core along the second direction. The side plate includes a plurality of plate fins.

11 Claims, 7 Drawing Sheets

COMPARATIVE EXAMPLE

HEAT EXCHANGER SIDE PLATE WITH FIN

TECHNICAL FIELD

The present disclosure relates to a heat exchanger having a side plate with a plurality of fins.

BACKGROUND

A heat exchanger includes a core having a plurality of tubes and a plurality of fins stacked with one another. A heat exchanger may include side plates that are stacked with the core on both sides of the core. The side plates are disposed to mechanically reinforce the core.

Generally, heat exchanging performance of a heat exchanger is enhanced by increasing the number of pairs of a tube and a fin (hereinafter, "tube-fin pair") of the core. However, the increase in the number of tube-fin pairs may lead to an increase in the size of the core in the stack direction of the tubes and the fins.

SUMMARY

This section provides a general summary of the disclosure, and is not a comprehensive disclosure of its full scope or all of its features.

An aspect of the present disclosure provides for a heat exchanger that includes a core, which has a plurality of core fins and a plurality of tubes, and a side plate. The plurality of tubes extend along a first direction. The plurality of core fins are stacked with the plurality of tubes along a second direction, which is perpendicular to the first direction. The side plate is stacked with the core along the second direction. The side plate includes a plurality of plate fins.

According to the aspect of the present disclosure, the side plate has plate fins that serve as additional core fins of the core.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure. In the drawings.

DETAILED DESCRIPTION

Figure 1:
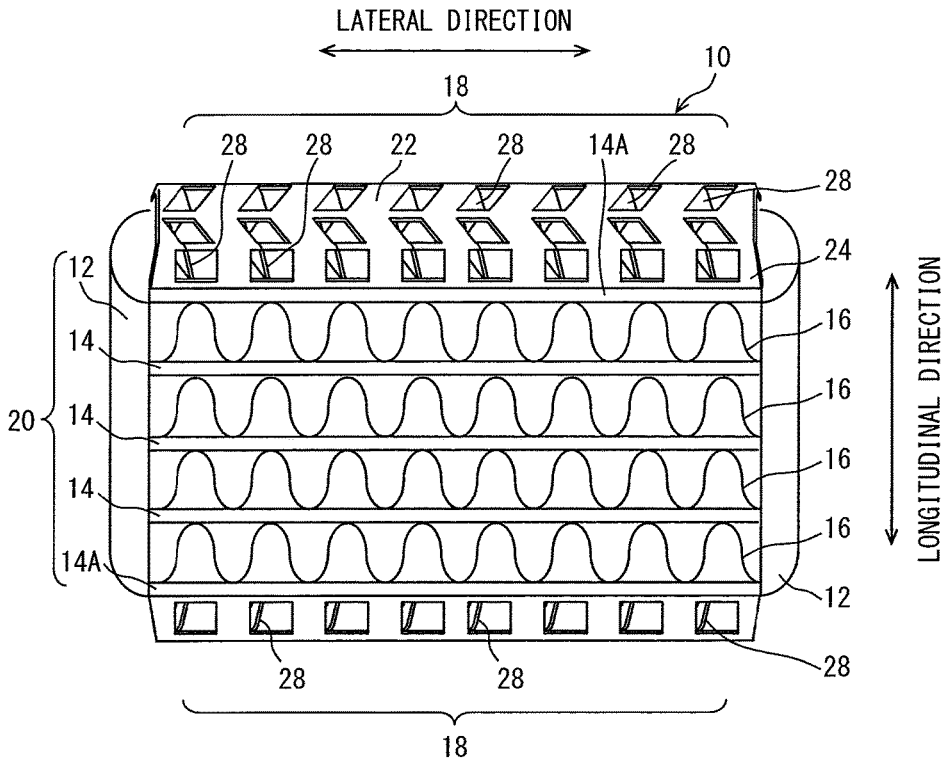
FIG. 1 is a schematic view showing a condenser according to a first embodiment.

A plurality of embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts may be combined. The embodiments may be partially combined even if it is not explicitly described that the embodiments may be combined, provided there is no harm in the combination.

First Embodiment

FIG. 1 illustrates a condenser 10, which acts as a heat exchanger according to the first embodiment. The condenser 10 includes two side tanks 12, a plurality of tubes 14, a plurality of fins 16 (core fins), and two side plates 18. The side tanks 12, the tubes 14, the fins 16, and side plates 18 are integrated with each other and brazed into one component. The condenser 10 serves as a portion of a refrigerant circuit (not shown) through which a thermal medium, such as CO2, circulates. The refrigerant circuit includes, for example, the condenser 10, a thermal expansion valve, a compressor, and an evaporator (not shown), which are connected with each other via pipes (not shown).

The tubes 14 extend along a lateral direction, or a first direction to be parallel with each other, and the thermal medium flows through the tubes 14. Each of the fins 16 is formed in a wave form and extends in the lateral direction to be parallel with each other. The tubes 14 and the fins 16 are stacked alternately along a longitudinal direction, or a second direction, which is perpendicular to the lateral direction, and form a core 20 of the condenser 10. Air passages are defined between each of the fins 16 and adjacent tubes 14, and air flows through these air passages in an airflow direction (third direction), as shown by the arrow in FIG. 4. The airflow direction is perpendicular to both the lateral direction and the longitudinal direction. The fins 16 enhance a heat exchanging performance of the core 20 between the thermal medium, which flows through the tubes 14, and air, which passes through the air passages.

The two side tanks 12 are disposed on two opposing sides of the core 20. The tubes 14 and the fins 16 of the core 20 are interposed between the side tanks 12 in the lateral direction. Each end of the tubes 14 is inserted into a respective one of the side tanks 12 to be in fluid communication with fluid spaces formed inside the side tanks 12. The side tanks 12 and the tubes 14 together form a fluid passage through which the thermal medium flows. For example, one side tank 12 is connected to the compressor via a pipe, and the other side tank 12 is connected to the thermal expansion valve via a pipe.

Each side plate 18 is stacked with the core 20 along the longitudinal direction. Specifically, the two side plates 18 are disposed on two opposing side portions of the core 20 to mechanically reinforce the core 20. In the present embodiment, the outermost tubes 14A of the plurality of tubes 14 in the longitudinal direction form the two opposing side portions of the core 20. Therefore, each side plate 18 is proximal to one outermost tube 14A. Hereinafter, where appropriate, each outermost tube 14A in the longitudinal will be referred to as "a side portion 14A of the core 20".

Figure 2:
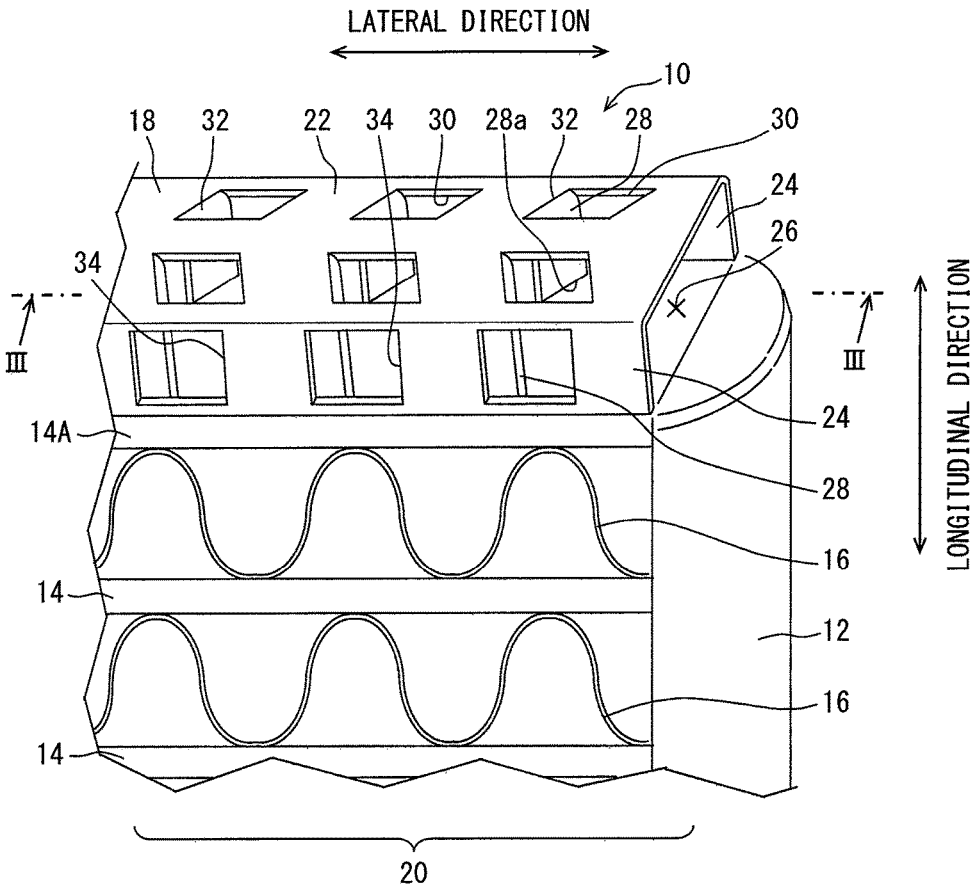
FIG. 2 is an enlarged view of a portion of the condenser according to the first embodiment.

Hereinafter, the side plate 18 will be described more detail. The two side plates 18 have the substantially same configuration, and thus one side plate 18 will be described below and details of the other side plate 18 will be omitted for brevity. As shown in FIG. 2, the side plate 18 has a cross section in a U-shape when viewed along the lateral direction. For example, the side plate 18 may be formed by bending both side edges of a flat-elongated sheet. The side plate 18 includes a plate body 22 and two plate arms 24. The plate body 22 is spaced away from, and faces, the side portion 14A of the core 20. The plate body 22 has a flat shape extending along the lateral direction. The plate arms 24 extend from both side edges of the plate body 22. Specifically, the plate arms 24 extend from the plate body 22 toward the the side portion 14A of the core 20. When the side plate 18 is disposed on the side portion 14A of the core 20, the plate body 22, the two plate arms 24, and the side portion 14A of the core 20 together define an internal space 26. The two plate arms 24 are attached to the core 20, whereby the plate body 22 is connected with the core 20 by the two plate arms 24.

Figure 3:
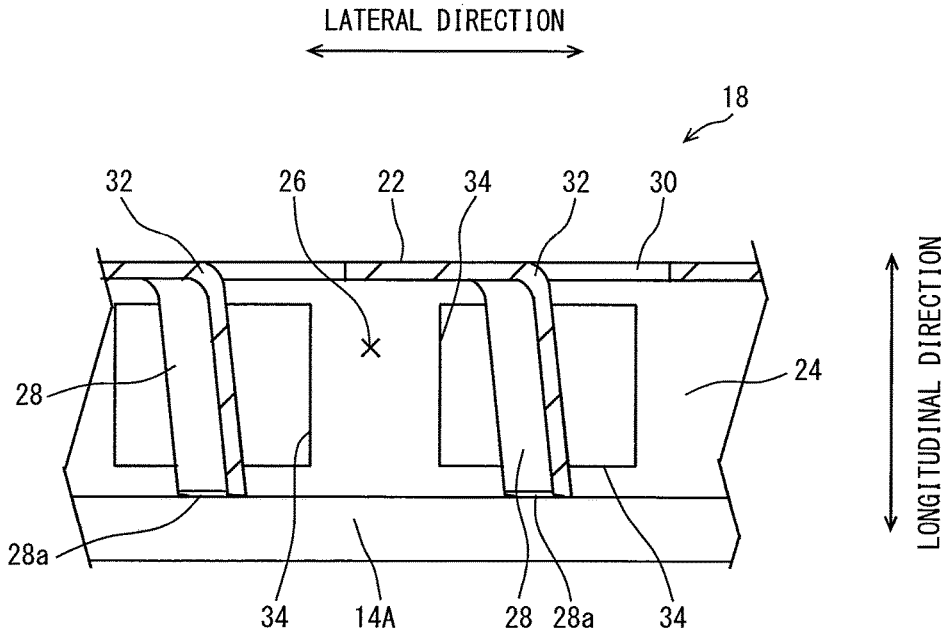
FIG. 3 is a cross-sectional view of a side plate according to the first embodiment.

As shown in FIG. 3, the side plate 18 includes a plurality of plate fins 28. The plate fins 28 are formed in the plate body 22 and extend from the plate body 22 toward the side portion 14A of the core 20. In other words, the plate fins 28 extend from the plate body 22 toward the internal space 26.

In one example, the plate fins 28 may be formed by stamping the plate body 22 in the longitudinal direction. Specifically, a die (not illustrated) having blades, which are arranged in a substantially U-shape, is pressed onto the side plate 18, thereby thrusting the blades through the plate body 22 and into the internal space 26. As a result, the stamped portion of the plate body 22 is bent into the internal space 26, resulting in forming the plate fin 28. At the same time, an open slot 30, which has a substantially parallelogram shape, is formed in the plate body 22 at a position corresponding to the stamped portion of the plate body 22. As shown in FIG. 1, a plurality of open slots 30 corresponding to the plate fins 28 are formed in the plate body 22. Each open slot 30 is open in the longitudinal direction so that the internal space 26 is in communication with the outside of the side plate 18 through the open slots 30. In this way, the plate fins 28 are integrally formed with the plate body 22. That is, the plate fins 28 are monolithic with the plate body 22.

As described above, since the plate fins 28 are formed by stamping a die into the internal space 26, the plate fins 28 (cantilevered portions) are cantilevered from the plate body 22 into the internal space 26. Specifically, as shown in FIG. 3, each plate fin 28 is cantilevered, at a root portion 32 thereof, with respect to the plate body 22 to define the open slot 30 in the plate body 22. Further, each plate fin 28 has a distal portion 28*a* that is disposed within the internal space 26. The distal portion 28*a* of the plate fin 28 may be in contact with the side portion 14A of the core 20. As illustrated in FIG. 3, the root portion 32 is closer to the plate body 22 than the distal portion 28*a* of the plate fin 28.

Figure 4:
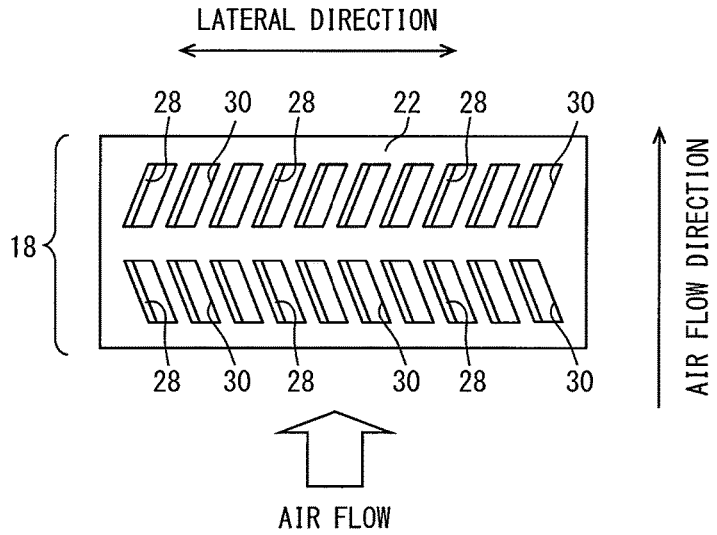
FIG. 4 is a plan view of the side plate according to the first embodiment.

As shown in FIG. 4, the plate fins 28 are arranged in pairs in the airflow direction, and the pairs of plate fins 28 are arranged along the lateral direction to form two parallel lines of the plate fins 28. The number of the plate fins 28 (and the open slots 30) in one of the lines is the same as that of the other line. As shown in FIG. 4, the open slots 30 and the plate fins 28 are angled in both the lateral direction of the side plate 18 and the airflow direction of the airflow. In the present embodiment, each of the pairs of plate fins 28 (and the open slots 30) forms a V-shape when viewed in the longitudinal direction. In addition, the open slots 30 may form ventilation passages to communicate the internal space 26 with the outside of the condenser 10.

As shown in FIG. 2, each plate arm 24 has a plurality of apertures 34, which are open in the airflow direction. The apertures 34 are arranged along the lateral direction. The apertures 34 are provided such that each aperture 34 corresponds to a respective one of the plate fins 28. Thus, the number of the apertures 34 in each plate arm 24 is the number of the pairs of plate fins 28 of the plate body 22. Each aperture 34 is arranged to overlap, in the airflow direction, with its corresponding plate fin 28. The air flows, in the airflow direction, into and out of the internal space 26 (i.e., the V-shaped airflow passages) through the apertures 34.

According to the above-described configurations, the side plate 18 has the plate fins 28 in the internal space 26, through which air flows. When air flows through the internal space 26, heat is exchanged between the air and the thermal medium flowing through the outermost tube 14A, which is connected to the plate fins 28. Thus, the plate fins 28 of the side plate 18 may similarly serve as the fins 16 of the core 20. In other words, the side plate 18 may provide a heat exchanging function in addition to the reinforcing function for the core 20.

Furthermore, because the plate fins 28 are angled in both the lateral direction and the airflow direction and the apertures 34 are overlapped with their corresponding plate fins 28, the plate fins 28 act as "baffles" that disrupt the flow of air through the internal space 26. As a result, the heat exchanging performance by the side plate 18 may be accelerated.

Figure 5:
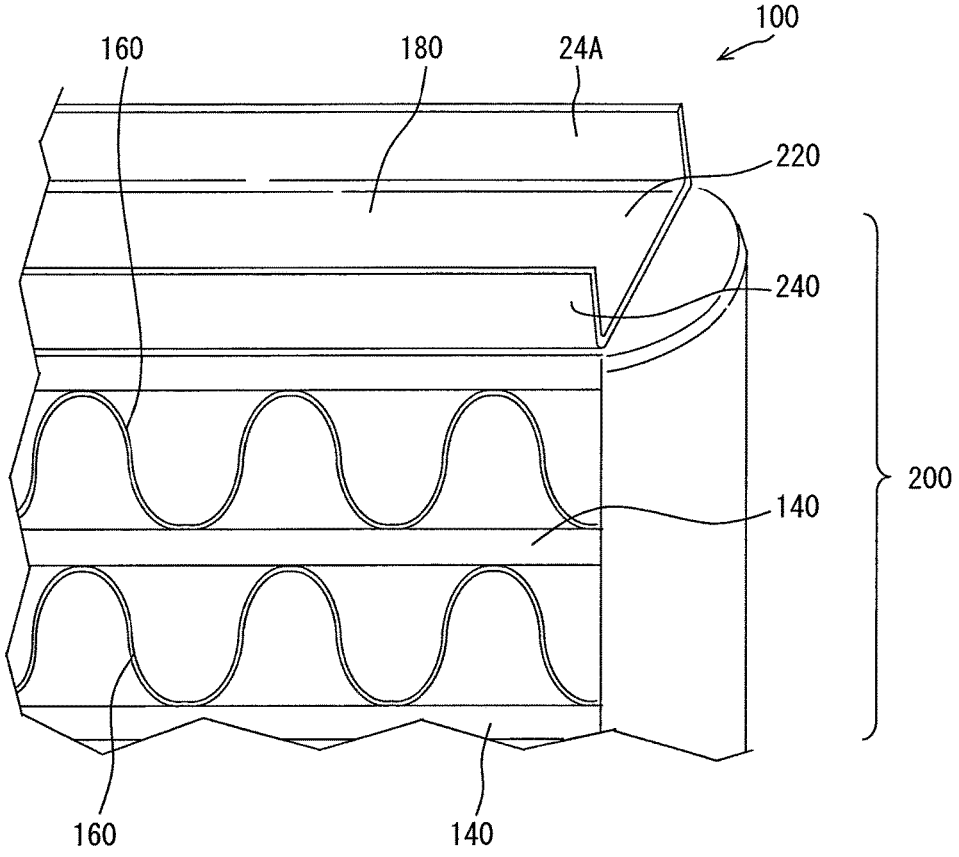
FIG. 5 is an enlarged view of a portion of a condenser according to a comparative example.

FIG. 5 shows a condenser 100 as a comparative example. This condenser 100 includes side plates 180 each having a cross section in a U-shape. In the comparative example, plate arms 240 extend away from a core 200 (a tube 140) from a plate body 220. Comparing with the condenser 100 of the comparative example, the condenser 10 according to the present embodiment may provide the heat exchanging function by the plate fins 28 of the side plates 18 in addition to the heat exchanging function by the fins 16 of the core 20. Therefore, assuming that the condenser 10 of the present embodiment has the same size as the condenser 100 of the comparative example (i.e., has the same number of tube-fin pairs), the condenser 10 of the present embodiment may more efficiently exchange heat between air and the thermal medium in comparison with the comparative example. In other words, to achieve the same performance as that of the condenser 10 of the present embodiment, the condenser 100 of the comparative example may need to add two fins 160 to the core 200, which results in enlarging the size of the condenser 100 of the comparative example in the longitudinal direction. Thus, the condenser 10 of the present embodiment may provide, without enlarging the size thereof in the longitudinal direction, greater performance than that of the condenser 100 of the comparative example.

Second Embodiment

Figure 6:
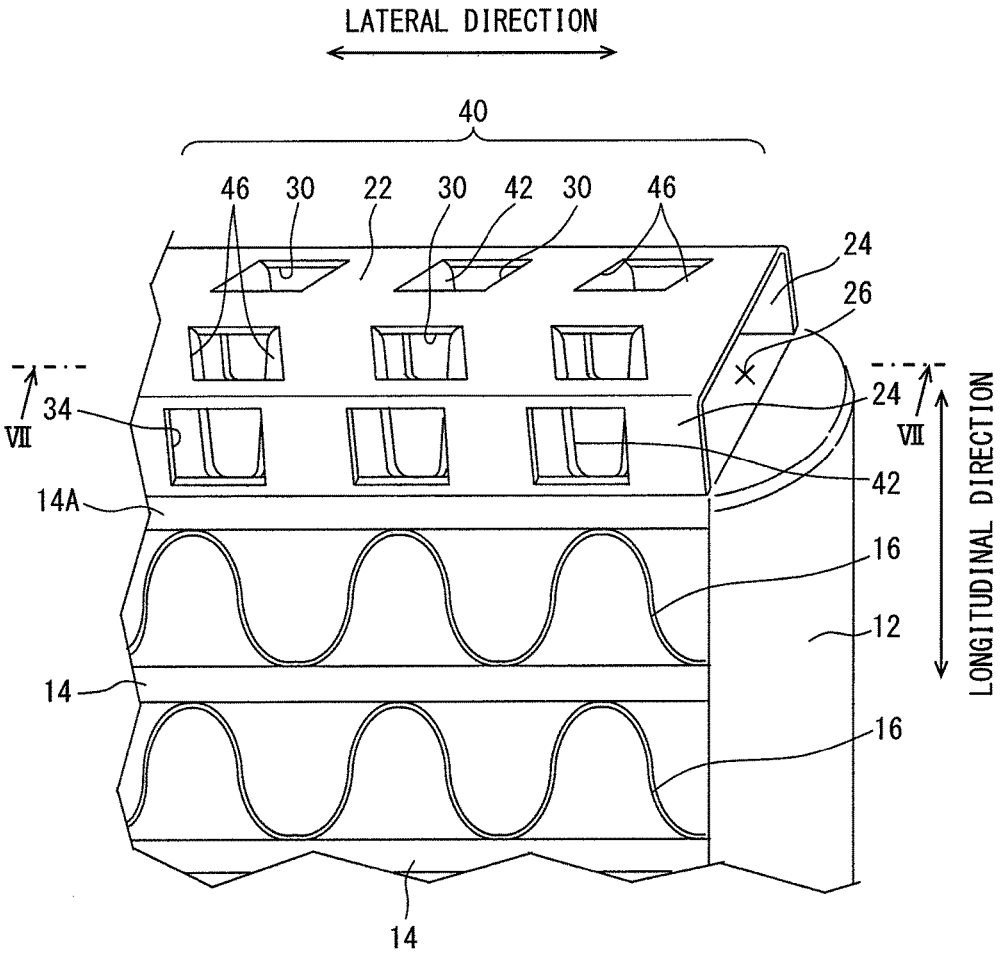
FIG. 6 is an enlarged view of a portion of a condenser according to a second embodiment.
Figure 7:
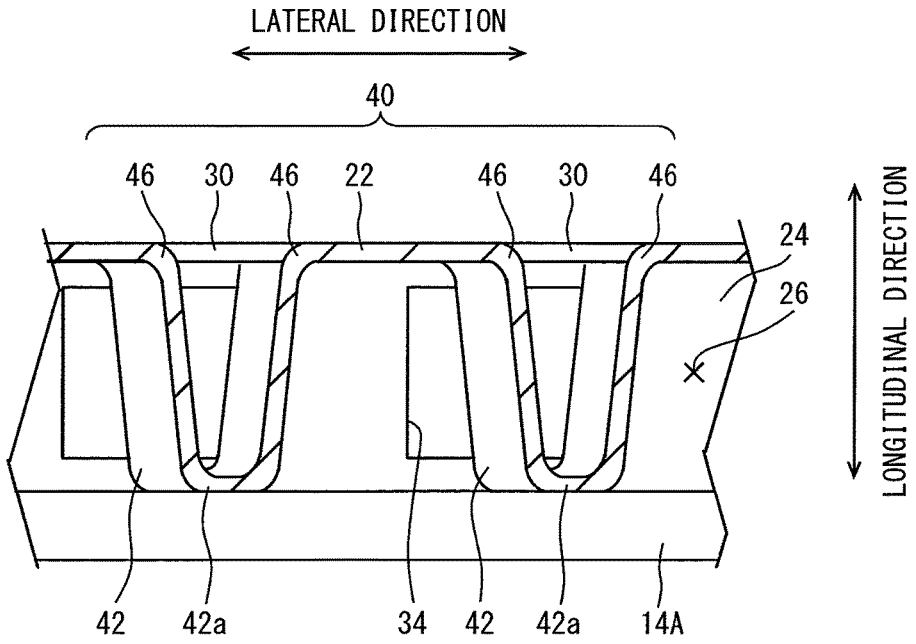
FIG. 7 is a cross-sectional view of a side plate according to the second embodiment.

As shown in FIGS. 6 and 7, a side plate 40 according to the second embodiment has a plurality of plate fins 42. The plate fins 42 have a wave shape and formed as depressions in a plate body 22. Similar to the first embodiment, the plate fins 42 may be formed by stamping the plate body 22 toward an internal space 26. Hence, the plate fins 42 may be integrally formed (monolithic) with the plate body 44.

More specifically, each plate fin 42 may be in a chamfered trapezoidal shape when viewed along the airflow direction. The each plate fins 42 is depressed, between two root portions 46 thereof, with respect to the plate body 22 into an internal space 26 of the side plate 40. By being depressed from the plate body 22, an open slot 30 is defined in the plate body 22. Each of the plate fins 42 has an end portion (distal portion) 42*a* that is disposed in the internal space 26 and is in contact with the side portion 14A of the core 20. Furthermore, the plate arms 24 have a plurality of apertures 34 in the lateral direction and each aperture 34 is arranged in the plate arms 24 to overlap with the corresponding plate fin 42 in an airflow direction, as shown in FIG. 6.

As with the first embodiment, the side plate 40 may provide the heat exchanging function, whereby the condenser (heat exchanger) according to the second embodiment may enhance the heat exchanging performance without increasing the size of the condenser.

Third Embodiment

Figure 8:
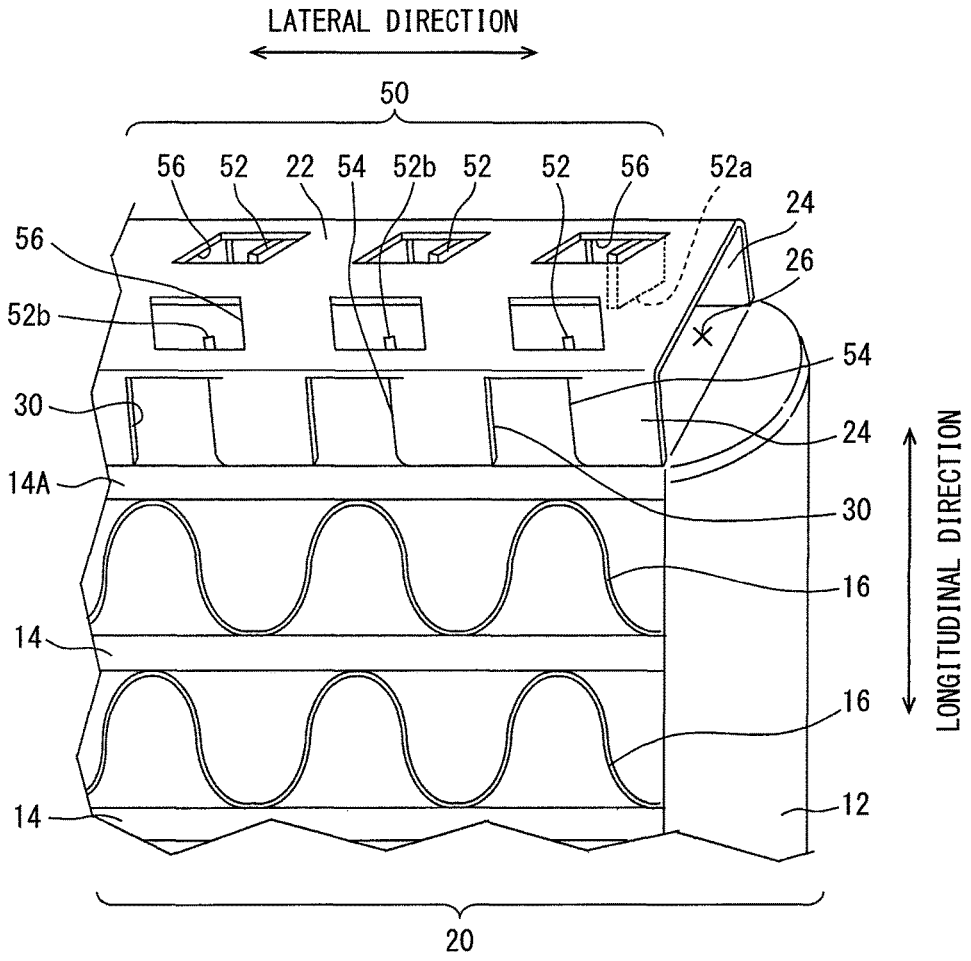
FIG. 8 is an enlarged view of a portion of a condenser according to a third embodiment.

As shown in FIG. 8, a side plate 50 according to the third embodiment includes two plate arms 24 each having a plurality of plate fins 52. The plate fins 52 may be formed by stamping the plate arms 24 into an internal space 26. In other words, the plate fins 52 are integrally formed (monolithic) with the plate body 22. More specifically, each plate fin 52 is a cantilevered portion that is cantilevered, at a root portion 54 thereof, from the plate arm 24 to define an open slot 30 in the plate arm 24. The plate fins 52 extend from the plate arm 24 toward the internal space 26. As with the first embodiment, each of the plate fins 52 is angled in both the lateral direction and the airflow direction. More specifically, pairs of plate fins 52 adjacent to each other in the airflow direction form a V-shape in viewed along the longitudinal direction. Each plate fin 52 has a side edge portion 52*a*, which may be in contact with the side portion 14A of the core 20.

The open slots 30 are open in the airflow direction, through which air flows into and out of the internal space 26. Each open slot 30 and the corresponding plate fins 52 overlap with each other in the airflow direction. More specifically, each plate fin 52 extends from one edge of the open slot 30 such that a distal end 52*b* of the plate fin 52 is closer to the other edge of the open slot 30, which is opposite to the one edge of the open slot 30, in the lateral direction than the root portion 54 of the plate fin 52. According to this configuration, the plate fins 52 in the third embodiment also act as baffles that disrupt the flow of air through the internal space 26. As a result, the heat exchanging performance by the side plate 50 is enhanced. Furthermore, the plate body 22 has a plurality of apertures 56 that are open in the longitudinal direction. Each aperture 56 is formed to correspond with a respective one of the plate fins 52. More specifically, each aperture 56 is arranged in the plate body 22 to overlap with its corresponding plate fins 52 in the longitudinal direction. It should be noted that the apertures 56 are optional, and the plate body 22 may not have the apertures 56.

As with the first and second embodiments, the side plate 50 of the third embodiment may provide the heat exchanging function, whereby the condenser (heat exchanger) according to the third embodiment enhances the heat exchanging performance without increasing the size of the condenser.

Other Embodiment

In the above-described embodiments, the outermost tubes of the plurality of tubes 14 in the longitudinal direction form the two opposing side portions 14A of the core 20, and the plate fins 28, 42, 52 are in contact with these outermost ones of the tubes 14. However, the two opposing side portions 14A of the core 20 may be formed of outermost fins of the plurality of fins 16 (core fins) instead, and the plate fins 28, 42, 52 may be in contact with the fins 16 of the core 20.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed. As used herein, the term "and/or" includes any and all combinations of one or more of the associated listed items.

What is claimed is:

1. A heat exchanger comprising:

a core including a plurality of core fins and a plurality of tubes; and a side plate, wherein the plurality of tubes extend along a first direction, the plurality of core fins are stacked with the plurality of tubes along a second direction, the second direction being perpendicular to the first direction, the side plate is stacked with the core along the second direction, and the side plate includes a plurality of plate fins, wherein the side plate is disposed on a side portion of the core and includes a plate body and two plate arms, the plate body is spaced away from, and faces, the side portion of the core in the second direction, the two plate arms extend from the plate body toward the side portion of the core, and the plate body is connected to the core by the two plate arms, wherein the plate body, the two plate arms, and the side portion of the core together define an internal space, wherein the two plate arms include a plurality of apertures through which air flows, in a third direction, into and out of the internal space, the third direction being perpendicular to the first and second directions, and each of the plurality of apertures corresponds to a respective one of the plurality of plate fins.

2. The heat exchanger according to claim 1, wherein the plurality of plate fins are formed in the plate body and extend from the plate body toward the side portion of the core.

3. The heat exchanger according to claim 2, wherein each of the plurality of plate fins includes a distal portion that is disposed within the internal space and is in contact with the side portion of the core.

4. The heat exchanger according to claim 1, wherein each of the plurality of apertures is arranged to overlap, in the third direction, with the corresponding one of the plurality of plate fins.

5. The heat exchanger according to claim 2, wherein each of the plurality of plate fins is a cantilevered portion of the plate body.

6. The heat exchanger according to claim 5, wherein each of the plurality of plate fins is cantilevered, at a root portion thereof, with respect to the plate body to define an open slot in the plate body.

7. The heat exchanger according to claim 1, wherein the side portion of the core is one of the plurality of tubes or one of the plurality of core fins.

8. The heat exchanger according to claim 7, further comprising:

a side tank that is disposed on the core, wherein the side tank is in fluid communication with the plurality of tubes.

9. A side plate for a heat exchanger, the side plate comprising:

a plate body spaced away from, and facing, a side portion of a core;

two plate arms extending from the plate body toward the side portion of the core; and a plurality of plate fins, wherein the plate body and the two plate arms define an internal space together with the side portion of the core, and the plurality of plate fins extend toward the internal space, wherein the two plate arms include a plurality of apertures through which air flows, in an airflow direction, into and out of the internal space, and each of the plurality of apertures corresponds to a respective one of the plurality of plate fins.

10. The side plate according to claim 9, wherein the plurality of plate fins are formed in the plate body and extend from the plate body toward the side portion of the core.

11. The side plate according to claim 9, wherein each of the plurality of apertures is arranged to overlap, in the airflow direction, with the corresponding one of the plurality of plate fins.

* * * * *